US007150231B2

(12) United States Patent
Olofsson

(10) Patent No.: US 7,150,231 B2
(45) Date of Patent: Dec. 19, 2006

(54) ACTIVE PART

(75) Inventor: Göran Olofsson, Eskilstuna (SE)

(73) Assignee: Saab AB, Linköping (SE)

( * ) Notice: Subject to any disclaimer, the term of this patent is extended or adjusted under 35 U.S.C. 154(b) by 322 days.

(21) Appl. No.: 10/809,328

(22) Filed: Mar. 26, 2004

(65) Prior Publication Data

US 2006/0254451 A1 Nov. 16, 2006

(30) Foreign Application Priority Data

Mar. 26, 2003 (SE) ..... 0300834

(51) Int. Cl.
*F42B 39/14* (2006.01)
*F42B 39/20* (2006.01)

(52) U.S. Cl. ..... 102/481; 102/476; 102/306

(58) Field of Classification Search ..... 102/306, 102/307, 308, 309, 310, 476, 701, 305, 475, 102/481

See application file for complete search history.

(56) References Cited

U.S. PATENT DOCUMENTS

| | | | | |
|---|---|---|---|---|
| 3,978,795 | A * | 9/1976 | Strunk et al. | 102/476 |
| 4,365,556 | A * | 12/1982 | Reibel | 102/307 |
| 4,703,695 | A | 11/1987 | Langer | |
| 4,798,145 | A * | 1/1989 | McVeagh | 102/476 |
| 4,951,572 | A | 8/1990 | Böcker et al. | |
| 5,153,373 | A * | 10/1992 | Lips et al. | 102/476 |
| 5,351,622 | A | 10/1994 | Ekholm | |
| H1504 | H * | 12/1995 | Crabtree | 102/476 |
| 5,902,954 | A * | 5/1999 | Hetz | 102/307 |
| 6,035,631 | A * | 3/2000 | Cannon | 60/255 |
| 6,453,817 | B1 * | 9/2002 | Markel et al. | 102/306 |
| 6,752,085 | B1 * | 6/2004 | Roach | 102/481 |

FOREIGN PATENT DOCUMENTS

| | | | |
|---|---|---|---|
| DE | 2046372 | A | 3/1972 |
| EP | 0491587 | A1 | 6/1992 |
| EP | 1363102 | A2 * | 11/2003 |
| FR | 1593370 | | 7/1970 |
| GB | 578845 | A | 7/1946 |
| GB | 2198817 | A | 6/1988 |
| SE | 501121 | C2 | 11/1994 |
| WO | WO 0203019 | A1 | 1/2002 |

* cited by examiner

*Primary Examiner*—Michael J. Carone
*Assistant Examiner*—James S. Bergin
(74) *Attorney, Agent, or Firm*—Venable LLP; Eric J. Franklin

(57) ABSTRACT

An active part of an ammunition device. A casing is provided with a sleeve in association with an opening of the casing. A sprung device is arranged between a locking device arranged at the opening of the casing and the sleeve. The end of the sleeve facing away from the sprung device contacts an explosive charge arranged inside the casing of the active part or a liner arranged on the surface of the explosive charge which faces towards the sleeve and the locking device. The locking device is designed to be released from the casing by the action of a force. The active part keeps the active part intact even if materials in the active part have greatly varying coefficients of thermal expansion, while at the same time, in extreme temperatures, the active part is prevented from detonating by the locking device being released from the casing.

11 Claims, 3 Drawing Sheets

ACTIVE PART

CROSS-REFERENCE TO RELATED APPLICATIONS

This application claims priority to Swedish patent application 0300834-9 filed Mar. 26, 2003.

FIELD OF THE INVENTION

The present invention relates to an active part comprised in an ammunition device, such shell, missile or the like, comprising a casing with an opening and containing an explosive charge designed to act through the opening in the casing, which explosive charge is under the influence of a sprung device connected to the casing in association with its opening via a locking device. The active part is particularly suitable for use with hollow charge shells and high-explosive shells.

BACKGROUND OF THE INVENTION

During the use and transportation of shells, there is a great risk that these will be exposed to shell splinters or fire from small-bore ammunition which can result in the shells detonating. In order to avoid or minimize the risk of the active part in a shell detonating, low-sensitive explosives are currently used, called insensitive munitions, abbreviation IM. A disadvantage of these explosives is that they have a much greater coefficient of thermal expansion than other materials normally comprised in an active part, such as aluminium, copper and iron in the liner or penetrating body and aluminium in the casing. As a shell is designed to be able to be used within a temperature range of more than 100° C., it is thus a question of large differences in the thermal expansion of the materials of which it is made. With temperature differences of the size stated, gaps can easily arise between the active part's liner and its explosive charge and between the active part's casing and its explosive charge due to differences in the coefficients of thermal expansion. These gaps eliminate or interfere with the hollow charge effect of the active part and risk setting off an unintentional detonation of the explosive charge.

The problem with differential thermal expansion is previously known in connection with ammunition, see for example GB 2 198 817. This document states that the explosive charge normally has a very much higher thermal expansion than the casing and liner. According to the application, the introduction is proposed of a specially-shaped sprung washer which is in contact with the liner of the explosive charge and engages in the casing of the charge.

When an explosive charge contained in the casing of an active part is subjected to a high temperature, there is also a great risk that the explosive charge will detonate. In order to eliminate this risk, the explosive charge should be able to be released from the interior of the active part.

SUMMARY OF THE INVENTION

The aim of the present invention is to achieve an active part which can deal in a reliable way with different coefficients of thermal expansion for the materials involved, within a temperature range which is acceptable from the point of view of a user, and which, outside this range, enables the explosive charge to be released from the casing of the active part. This will be achieved by means of a solution that is easy to integrate into the active part without interfering with the hollow charge effect or significantly changing the size of the explosive charge and preferably utilizing components that are already on the market in order to keep down the cost.

The aim of the invention is achieved by means of an active part characterized by a sleeve being arranged between the explosive charge and the locking device in such a way that it is able to be moved by the action of the said sprung device and by the locking device being designed to be able to be released from the casing by the action of pressure.

By means of the invention, an active part is achieved where temperature movements within an acceptable temperature range are absorbed by the movable sleeve and are dealt with in the interaction between the sprung device and the locking device. The sleeve will thereby always make contact with the explosive charge or its liner. A clearance is created within which the sleeve can be moved by the action of the thermal expansion without problems arising in the form of gaps and the like. When the thermal expansion assumes such proportions that the whole of the clearance has been utilized, the sleeve acts directly on the locking device and, if the thermal expansion continues, the locking device is released from the casing without causing a detonation of the explosive charge. The clearance between the locking device and the sleeve, which consists of an air space, can be dimensioned in accordance with the temperature range within which the active part is intended to be used or in accordance with how high a temperature the explosives can tolerate without detonating.

According to an advantageous embodiment, the active part is characterized in that the sleeve is designed with a first section matched to the internal dimensions of the casing and a second section matched to the internal dimensions of the locking device, with a stop surface arranged at the transition between the sections, intended to interact with a stop surface arranged in the locking device corresponding to the stop surface on the sleeve. The embodiment provides a well-defined and stable connection between the sleeve and the locking device in the situation when the locking device is designed to separate from the casing.

In another embodiment, the sprung device consists of several separate springs, separated by spacers lying between the springs. This embodiment enables a larger clearance to be created by simple means. The springs involved can advantageously consist of wave springs. The springs are easy to place in the transition between the sleeve and the locking device and several sprung layers can be built up by means of the spacers. In addition, the springs are of a type that is available on the open market.

With shells of the high-explosive type, the sleeve is suitably arranged to be in direct contact with the explosive charge.

With hollow charge shells, on the other hand, the sleeve is suitably arranged to be in direct contact with a liner arranged on the surface of the explosive charge facing towards the opening of the casing. In this case, according to an advantageous embodiment, the sleeve is designed with a peripheral recess in the side facing the explosive charge intended to engage with the liner of the explosive charge.

According to yet another advantageous embodiment, the active part is characterized in that the locking device is provided with a first and a second projecting ring-shaped lip, with the first lip being designed to engage in a ring-shaped recess in the casing of the active part close to its opening, and the second lip arranged to act as a stop lip interacting with the end of the casing at its opening. The design of the locking device provides a well-defined and reliable connection to the casing of the active part and can easily be separated from the casing at high temperatures. Alternatively, the locking device can be provided with screw threads for interaction with corresponding screw threads arranged in the casing of the active part.

BRIEF DESCRIPTION OF THE DRAWINGS

The invention will be described below in greater detail in the form of two embodiments with reference to the attached drawings in which:

FIG. 1 shows in cross-section from the side a first example of an active part according to the invention comprised in a shell or the like.

FIG. 3 shows in cross-section from the side a second example of an active part according to the invention comprised in a shell or the like.

DETAILED DESCRIPTION OF EMBODIMENTS OF THE INVENTION

Figure 1:
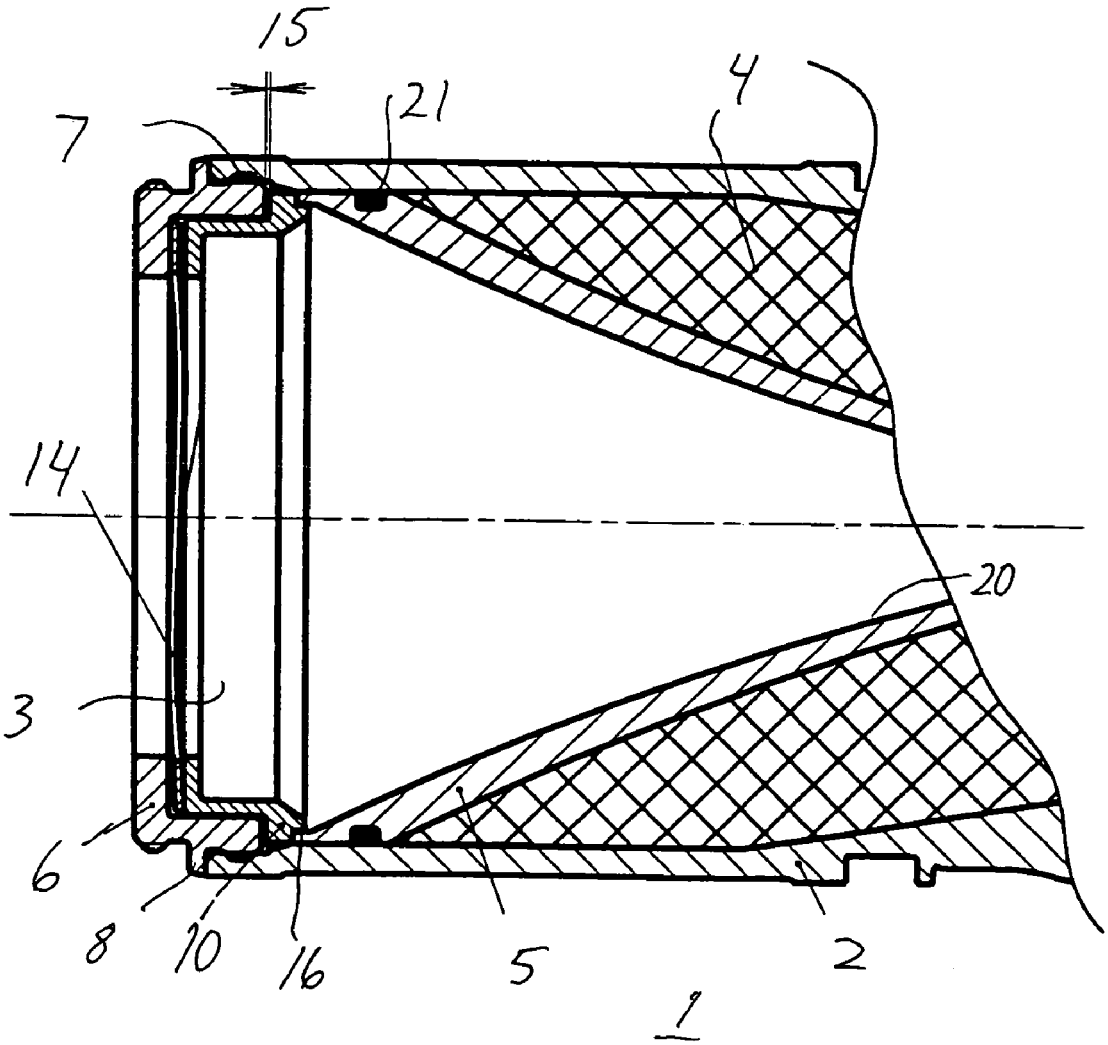
Figure 2:
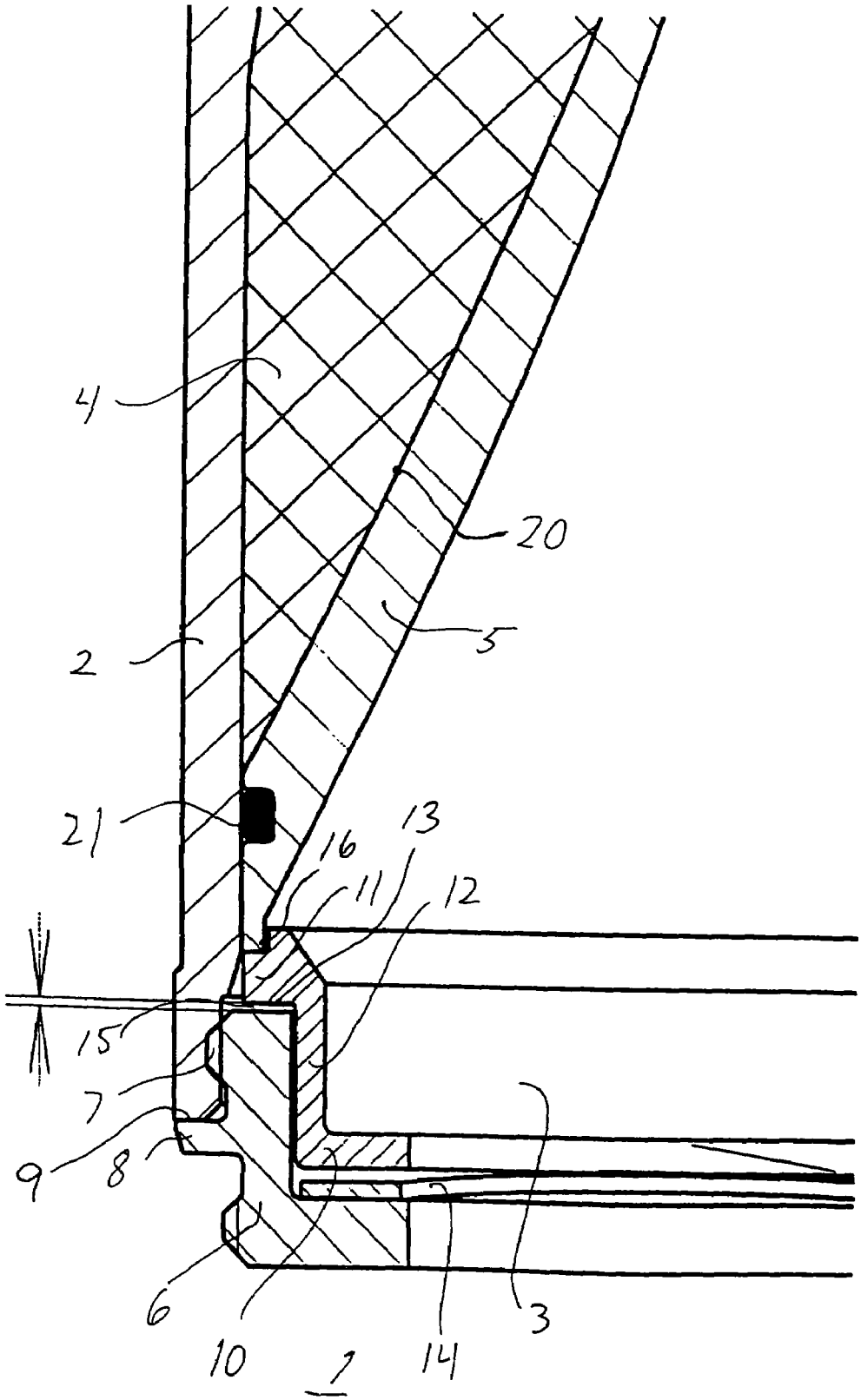
FIG. 2 shows in larger scale in cross-section from the side a smaller part of the active part according to FIG. 1.

A first embodiment will now be described with reference to FIGS. 1 and 2. The figures show an active part 1 which can be comprised in a shell (not shown) of the hollow charge type. The active part 1 has a cylindrical casing 2 with an opening 3. The casing 2 contains an explosive charge 4 consisting of any explosive substance that is already known in this connection. The part of the explosive charge 4, the surface of which is designated by 20, which faces towards the opening 3 in the casing, is provided with a liner 5. The liner 5 can also be called a penetrating body. An O-ring 21 surrounds the liner 5 in connection with the widest part of the liner and is located in a groove in the liner.

A locking device 6 is mounted in the opening 3 in the casing 2. The locking device is held in place in the opening 3 in the casing 2 by means of a connection 7. The connection 7 can consist of threads arranged on the periphery of the locking device 6 to interact with corresponding threads in the casing. Alternatively, the locking device can be provided with a projecting lip and the inner surface of the casing can be provided with a corresponding groove or vice versa. The locking device 6 comprises, in addition, an encircling projecting lip 8 which makes contact with the edge surface 9 of the casing 2 when the locking device is mounted in the opening in the casing.

A sleeve 10 is arranged in the space between the explosive charge 4 and the locking device 6. The sleeve has a first section 11 with an external diameter that essentially corresponds to the internal diameter of the casing and a second section 12 that essentially corresponds to the internal diameter of the locking device 6. At the transition between the two sections 11 and 12, there is a stop surface 13. A sprung device 14 in the form of a wave spring is arranged between the locking device 6 and the sleeve 10. The sprung device presses the sleeve 10 in the direction towards the explosive charge 4. The components used are so dimensioned that there is a clearance 15 in the form of an airspace within the temperature range within which the active part is normally intended to be used. In the first embodiment shown, the first section 11 of the sleeve is provided with an encircling recess 16 to make contact with the front part of the liner 5.

When the active part assumes different temperatures within its normal area of use, differences in the thermal expansion, particularly between the casing 2 and the explosive charge 4, will manifest themselves in a larger or smaller clearance 15. However, there will always be a clearance 15 and the sleeve 10 will always be in contact with the liner 5. If, however, the active part is subjected to temperatures outside the normal temperature range and there is a risk of detonation of the explosive charge, the differences between the thermal expansions of the different components will result in the stop surface of the sleeve 10 pressing against a corresponding surface on the locking device 6 and releasing the locking device from the casing 2 of the active part by the action of pressure.

Figure 3:
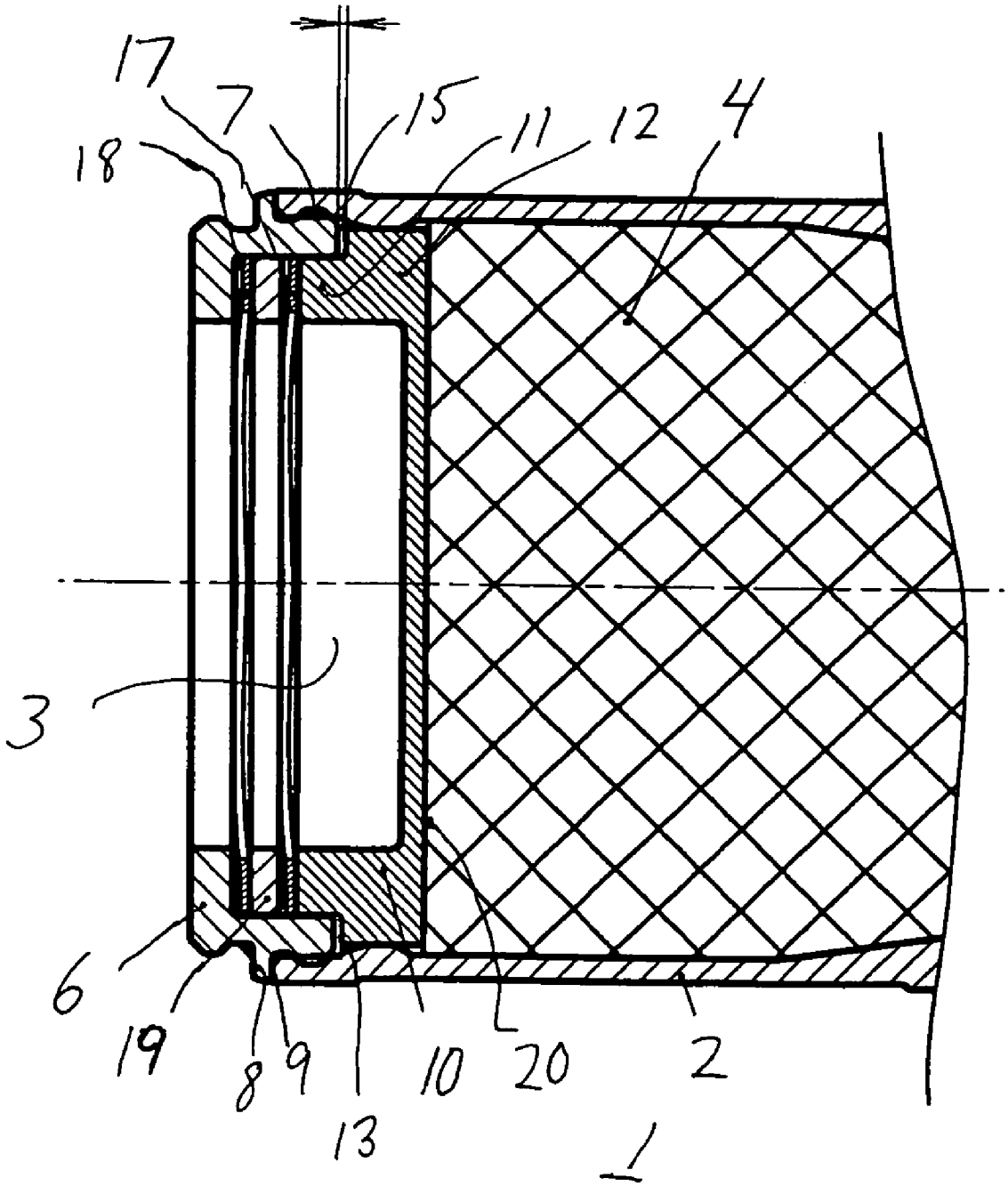

FIG. 3 shows a second embodiment which will now be described. Components that correspond to components in FIGS. 1 and 2 have been given the same reference numerals and will therefore not be described in greater detail here. The active part 1 shown here can be comprised in a high-explosive shell (not shown). In this case, the sleeve 10 is in direct contact with the explosive charge 4. The sprung device 14 consists of two springs 17 and 18 separated by a spacer 19. In principle, the locking device 6 and the sleeve 10 operate in the same way as described for FIGS. 1 and 2. Within the normal area of use, there is always a clearance 15, which can vary in size depending upon the temperature. In the event of more extreme temperatures outside the normal area of use, the sleeve 10 releases the locking device 6 from its connection 7 with the casing 2 by the action of pressure.

The invention is not limited to the embodiments described above by way of example, but can be modified within the framework of the following claims.

The invention claimed is:

1. An active part of an ammunition device, the active comprising:

a casing having an opening;

an explosive charge arranged in the casing, the explosive charge designed to act through the opening in the casing;

a locking device arranged at the opening of the casing;

a sleeve arranged between the explosive charge and the locking device; and a sprung device operative to apply a force to the sleeve in an axial direction of the active part, wherein the locking device is releasable from the casing by the action of pressure.

2. The active part according to claim 1, wherein the spring device causes the sleeve to exert a pressure against the explosive charge.

3. The active part according to claim 1, wherein the ammunition device comprises a shell.

4. The active part according to claim 1, wherein the sleeve comprises a first section matched to internal dimensions of the casing and a second section matched to internal dimensions of the locking device, a transition between the first section and the second section comprising a stop surface operative to interact with a stop surface in the locking device.

5. The active part according to claim 1, wherein the sprung device comprises at least one wave spring.

6. The active part according to claim 1, wherein the sprung device comprises a plurality of separate springs, the active part further comprising:

spacers arranged between the springs and operative separate the springs.

7. The active part according to claim 1, wherein the sleeve is arranged to be in direct contact with the explosive charge.

8. The active part according to claim 1, further comprising:

a liner arranged on a surface of the explosive charge and facing towards the opening in the casing, wherein the sleeve is arranged to directly contact the liner.

9. The active part according to claim 8, wherein the sleeve comprises a peripheral recess in a side facing towards the explosive charge, wherein the recess is operative to engage the liner.

10. The active part according to claim 1, wherein the locking device comprises a first projecting ring-shaped lip and a second projecting ring-shaped lip, wherein the casing comprises a ring-shaped recess arranged in the vicinity of the opening, wherein the first lip being operative to engage the ring-shaped recess arranged in the casing, and wherein the second lip is operative to act as a stop lip interacting with an end of the casing at the opening.

11. The active part according to claim 1, wherein the locking device and the casing comprise screw threads operative to interact each other.

* * * * *